US005752397A

United States Patent [19]

Bruntz

[11] Patent Number: 5,752,397

[45] Date of Patent: May 19, 1998

[54] UNBALANCE PREVENTION FOR AN ELECTROMECHANICAL MACHINE

[75] Inventor: Jordan S. Bruntz, Newton, Iowa

[73] Assignee: Maytag Corporation, Newton, Iowa

[21] Appl. No.: 662,667

[22] Filed: Jun. 14, 1996

[51] Int. Cl.[6] ..... D06F 33/02

[52] U.S. Cl. ..... 68/12.12; 68/12.14

[58] Field of Search ..... 68/12.06, 12.12, 68/12.14

[56] References Cited

U.S. PATENT DOCUMENTS

| | | | |
|---|---|---|---|
| 2,983,129 | 5/1961 | Metzger | 68/12.14 |
| 4,513,464 | 4/1985 | Rettich et al. | 8/159 |
| 4,782,544 | 11/1988 | Nystuen et al. | 8/159 |
| 4,843,671 | 7/1989 | Hirooka et al. | 8/159 |
| 5,361,439 | 11/1994 | Malchow | 8/158 |

FOREIGN PATENT DOCUMENTS

| | | | |
|---|---|---|---|
| 7575 | 1/1994 | Japan | 68/12.14 |

*Primary Examiner*—Philip R. Coe
*Attorney, Agent, or Firm*—Zarley, McKee, Thomte, Voorhees, & Sease

[57] ABSTRACT

An apparatus and method for preventing a load of clothing from becoming unbalanced during the spin cycle of a washing machine includes a control circuit which causes the washing machine to alternately spin and agitate during the spin cycle of the washing machine. The apparatus includes a pair of electrical relays, a power supply, and logic circuitry. The apparatus and method may include components required to provide self compensation based on user selected water levels.

22 Claims, 3 Drawing Sheets

UNBALANCE PREVENTION FOR AN ELECTROMECHANICAL MACHINE

BACKGROUND OF THE INVENTION

The present invention relates to washing machines. More particularly, the present invention relates to a device and method for controlling the spin cycle of a washing machine.

In a typical automatic washing machine, the washing process includes several wash cycles and rinse cycles in which the basket of the washing machine is filled with water. After these cycles are complete, a spin cycle is used to remove water from the clothing.

In a typical prior art automatic washing machine, during the spin cycles, the clothing in the machine can accumulate in one area or on one side of the spinning basket. The clothing also absorbs and releases water at different rates. These factors may result in an unbalanced load. An unbalanced load can cause noise, nuisance, and possibly damage to the washer if not controlled. Even careful packing of the clothing into the washing machine cannot always avoid an unbalanced load.

To deal with the problem, prior art washing machines have included a method of sensing an unbalanced load which in turn activates an alarm while stopping the spin cycle until the user redistributes the clothing in the washing machine. As a result, during the washing process, the automatic clothes washer will occasionally halt until the user redistributes the clothing in the washer to balance the load more. Not only is the unbalanced alarm annoying, but an unbalanced condition complicates and slows down the process of washing a load of clothing. A need can therefore be seen for an automatic washing machine which avoids an unbalanced condition.

A general object of the present invention is the provision of an improved automatic washing machine which overcomes the deficiencies found in the prior art.

A further object of the present invention is the provision of an automatic washing machine which uses a spin cycle that alternately spins and agitates the load of clothing to prevent an unbalanced condition.

A further feature of the present invention is the provision of an automatic washing machine which alternately spins and agitates a load of clothing for a short period of time during the spin cycle before continuing to spin the load of clothing at top speed.

Further objects, features and advantages of the present invention include:

An automatic washing machine that includes a circuit for controlling the spin cycle such that the washing machine alternately spins and agitates the clothing during the spin cycle.

An automatic washing machine which, during the spin cycle, spins and agitates the load of clothing at frequencies dependent on the size of the load.

These as well as other objects, features and advantages of the present invention will become apparent from the following specification and claims.

SUMMARY OF THE INVENTION

The present invention relates to a method and apparatus for preventing a load of clothing from becoming unbalanced during the spin cycle of a washing machine. The device includes circuitry which causes the washing machine to alternately spin and agitate during the spin cycle of the washing machine. The circuitry preferably includes a power supply, relays, a timer, and logic circuitry. The logic circuitry makes up a ring counter and a ripple counter which, along with the timer and relays, control the spin cycle of the washing machine.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalences which may be included within the spirit and scope of the invention.

Figure 1:
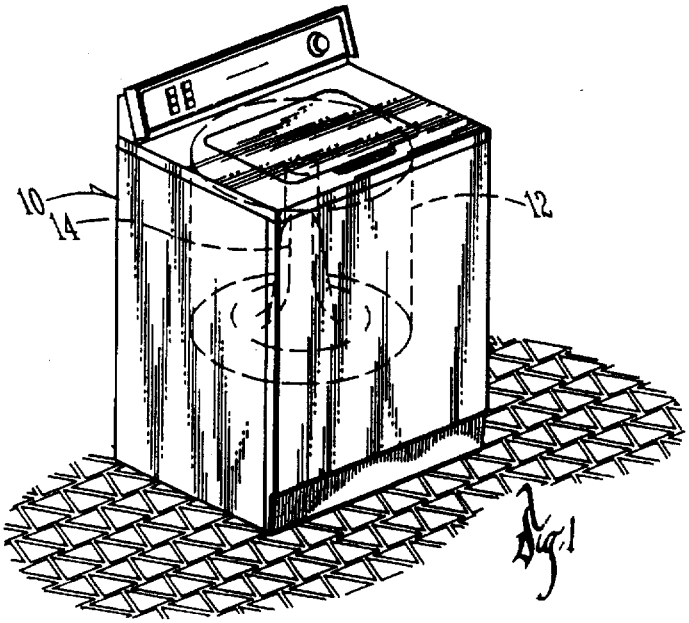
FIG. 1 is a perspective view of an automatic washing machine used with the present invention.

FIG. 1 shows an automatic clothes washing machine 10 including a rotatable perforated basket 12 which is mounted in a drum and which holds the clothing to be washed in the washing machine 10. Also shown in FIG. 1 is an agitator 14 which is used to agitate the clothing in the washing machine 10. In a typical wash cycle, the basket 12 is filled with clothing and detergent. The drum and basket 12 are filled with water and the clothes are agitated by a back and forth oscillating motion of the agitator 14 within the basket 12. The water is then drained while the basket 12 spins, thereby forcing water out of the clothing. This process is repeated without the detergent to rinse the clothing. The drum, basket 12 and agitator 14 have conventional construction.

Figure 2:
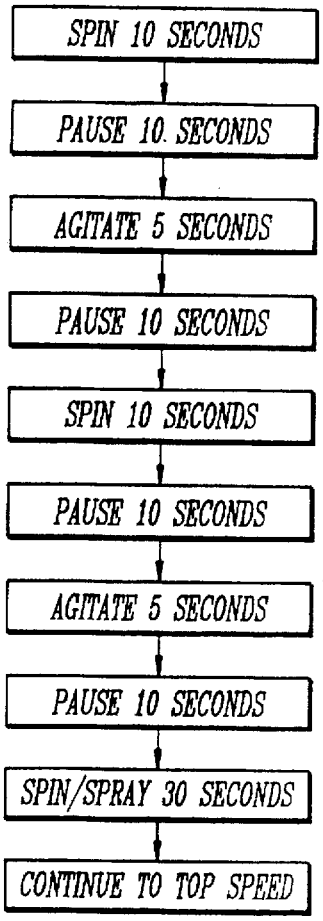
FIG. 2 is a flow diagram of the spin cycle of an embodiment of the present invention.

FIG. 2 shows a block diagram of an enhanced spin cycle used by the washing machine 10 which reduces the effects of an unbalanced load. The cycle illustrated in FIG. 2 redistributes the clothing and wets the clothing load more evenly. The cycle consists of partial spins followed by short agitation periods and finally a spin/spray while accelerating to the top spinning speed. During the spin/spray step the load is spun while spraying additional water into the basket 12.

The preferred timing algorithm, as seen in FIG. 2, is as follows for a full load, although variations are within the scope of the invention: ten second spin, ten second pause, five second agitate, ten second pause, ten second spin, ten second pause, five second agitate, ten second pause. After this sequence, the washing machine 10 would continue to accelerate to the top spinning speed. This process will prevent the washing basket 12 from becoming unbalanced during the high speed spin portion of the spin cycle.

Figure 3A:
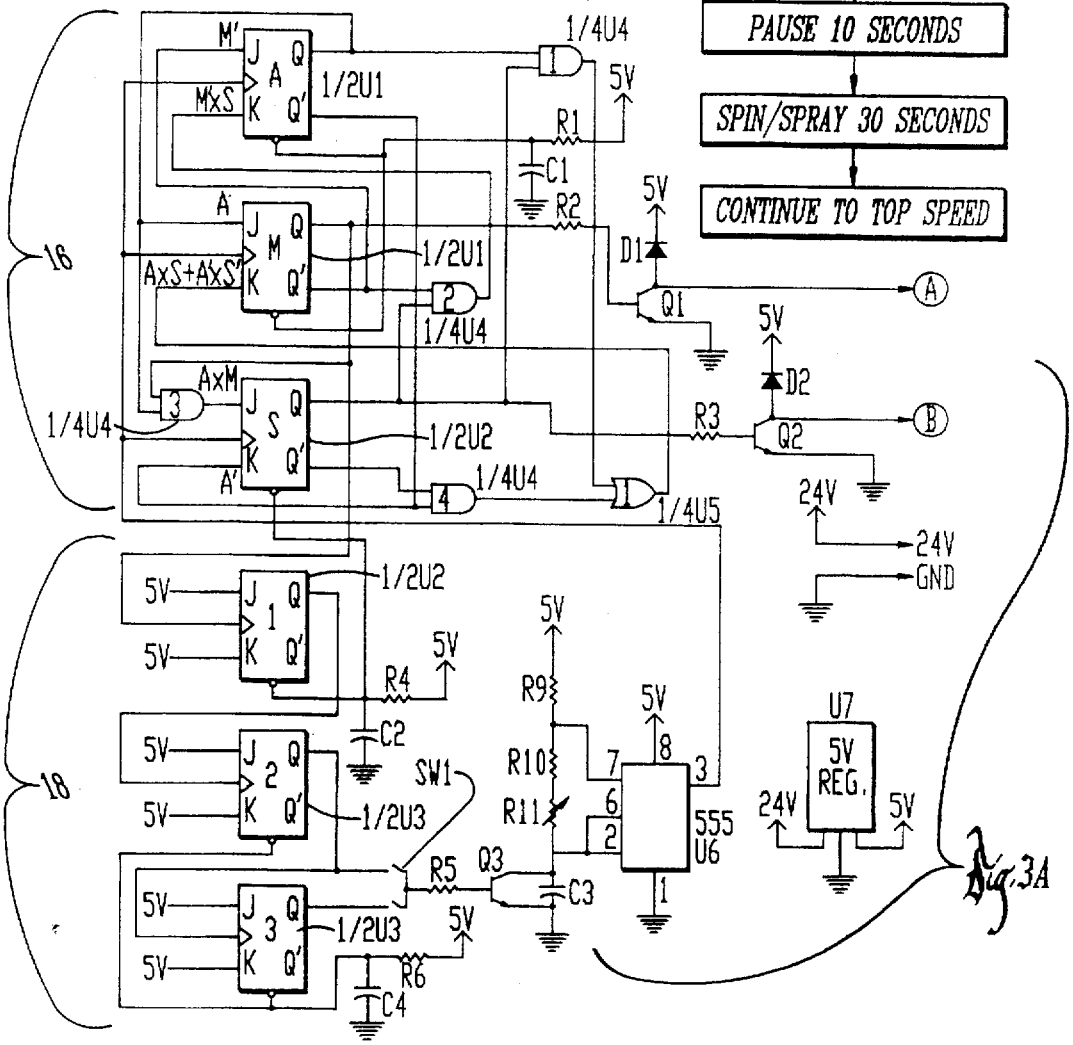
FIGS. 3A–3D are electrical schematic diagrams showing circuitry used in the present invention.
Figure 3B:
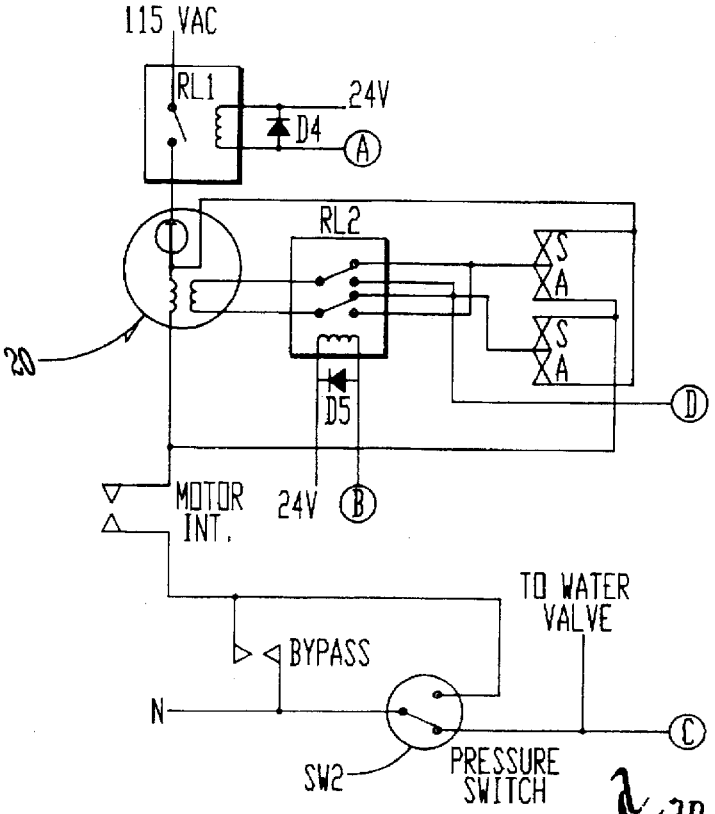
Figure 3C:
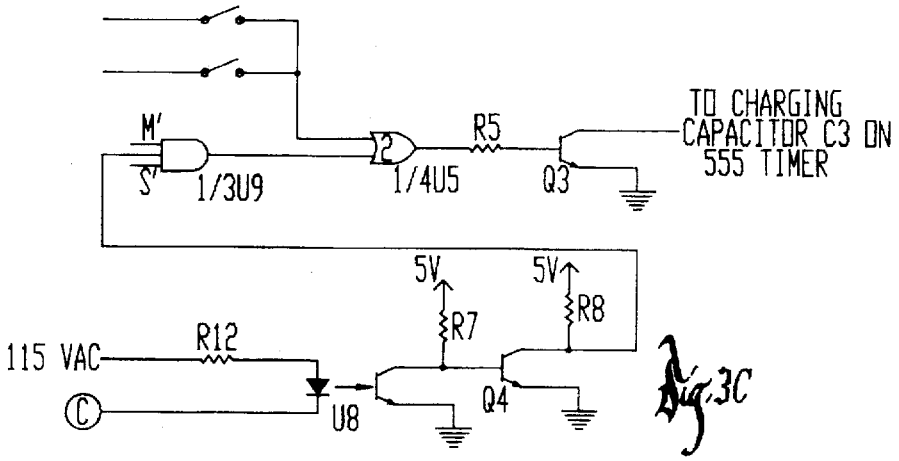
Figure 3D:
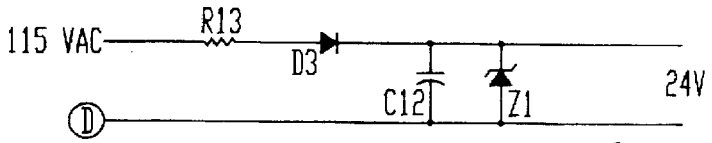
Figure 4:
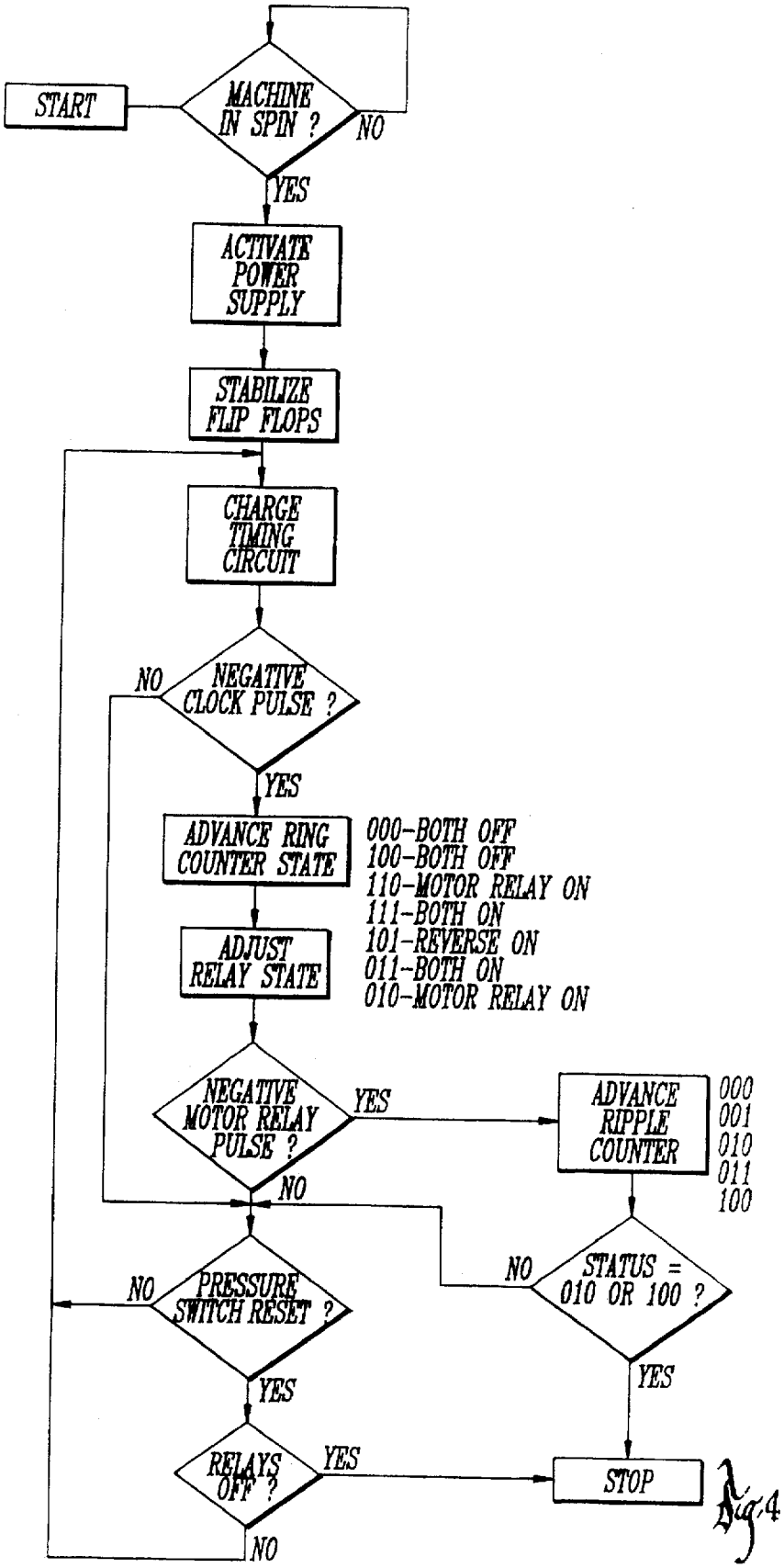
FIG. 4 is a flow chart of the process used by an embodiment of the present invention.

FIGS. 3A–3D along with the flow diagram of FIG. 4 detail a device for implementing the unbalanced prevention algorithm explained above. The device consists of two relays, a power supply, and logic circuitry. Whenever the washing machine 10 goes into the spin cycle, the device will stop the motor, reverse the start winding, and agitate for two short periods.

The present invention may optionally include components required to provide self compensation based on user selected water levels. For example, if a high water level is selected, two remix periods will be utilized. If a medium water level is selected, only one or perhaps two remix periods will occur. On a low water level selection, only one or perhaps zero remix periods will occur. This assumes that a pressure switch with a fixed reset is utilized.

FIGS. 3A–3D show the circuitry used with the preferred embodiment of the present invention. FIG. 4 is a flow diagram illustrating the operation of the circuitry.

FIG. 3A shows a ring counter 16 and a ripple counter 18. The ring counter 16 is comprised of three J-K flip-flops and five logic gates which are comprised of components Ul, one-half of U2, U4 and one-fourth of U5. As can be seen by the connection of these various logic components, the output sequence generated by the ring counter 16 will be 000, 100, 110, 111, 101, 011, 010, repeat. To help in understanding the output sequence, the logic value symbols are indicated at the inputs of each J-K flip-flop, for example the inputs to the A flip-flop are M' and M'xS where an "x" denotes the AND function and a "+" denotes the OR function. The last two bits of the output sequence (the outputs of the M and S flip-flops) are used to drive the motor relay RL1 and reversing relay RL2 (FIG. 3B). In terms of the control of the relays RL1 and RL2, the output sequence of the ring counter 16 will be: both relays off, both relays off, motor relay on, reversing relay on, motor relay off, motor relay on, reversing relay off, motor relay off.

Note that the output of a J-K flip-flop depends on the two inputs and the previous output state of the flip-flop. For example, if the inputs J and K are compliments of each other (one high and one low), the output will go to the value of the J input at the next clock edge. If the J and K inputs are both low, the output of the flip-flop will not change states. If the inputs J and K are both high, the output will toggle, or reverse its state after each clock pulse.

The ripple counter 18 shown in FIG. 3A is comprised of J-K flip-flops 1, 2, and 3 which consist of components U3 and one-half of U2. The flip flop 1 is clocked by the output of the M flip flop which also controls the motor relay. So, each time the motor relay turns off (in other words, each time the output of the M flip-flop of ring counter 16 goes from a high state to a low state), the flip-flop 1 of the ripple counter 18 is clocked and its output toggles to a high state (since the inputs to flip-flop 1 are always high). The output of flip-flop 1 is connected to the clock of flip-flop 2, therefore, two motor relay cycles will cause the second flip-flop to toggle to a high state. Similarly, the output of flip-flop 2 is connected to the clock of flip-flop 3 such that four cycles of the motor relay will cause the flip-flop 3 to toggle to a high state. Both inputs to the J-K flip-flops 1, 2, and 3 are connected to five volts such that with each clock edge of each respective flip-flop, the output of each respective flip-flop will change states.

By using switch SW1 to select an output from either the flip-flop 2 or flip-flop 3, the redistribution pattern can be performed once or twice (discussed below). For each negative edge of the motor relay output (the output of flip-flop M) the ripple counter 18 will have the following output sequence:000, 001, 010, 011, 100. The output of the ripple counter 18 is connected through switch SW1, resistor R5 and transistor Q3 to the timer U6. When the output of the ripple counter 18 is high, power is supplied to the base of transistor Q3 causing transistor Q3 to conduct, in effect, shorting timing capacitor C3 which terminates further timing.

Resistors R9, R10, R11, capacitor C3 and timer U6 are connected in a standard 555 timer arrangement. The clock frequency of the timer U6 is determined by the charging rate of capacitor C3 through the resistors R9, R10 and R11. The timing of the timer U6 can be interrupted via transistor Q3 by the ripple counters 18 as described above. The output of the timer U6 is connected to each of the clock inputs of the A, M and S flip-flops of the ring counter 16.

FIG. 3B shows the motor 20 along with the relays RL1 and RL2. The motor relay RL1 is a single pole double throw (SPDT) device. The normally open terminal is not used. The output of the ring counter (through flip-flop M) enables the motor relay RL1 through resistor R2, transistor Q1 and diode D1. When the flip-flop M output goes high, the power supplied to the base of transistor Q1 through resistor R2 causes transistor Q1 to conduct and activate the relay RL1. Diode D1 is used as a snubber to reduce noise as the magnetic field from the relay RL1 collapses. When the relay RL1 is switched on, the drive motor 20 is deactivated because of the normally closed contact arrangement of relay RL1. The motor 20 must be switched off before the motor winding polarity is reversed. The reversing relay RL2 shown in FIG. 3B is a double pole, double throw (DPDT) device. The output of the ring counter 16 coming from flip-flop S enables the reversing relay RL2 through resistor R3, transistor Q2 and diode D2. When the output of flip-flop S goes high, power supplied to the base of transistor Q2 through resistor R3 causes the transistor Q2 to conduct and activate the relay RL2. Diode D2 is used as a snubber to reduce noise as the magnetic field from the relay RL2 collapses. When the relay RL2 switches on, the motor windings are placed in the agitate polarity. Note that the washing machine 10 operates such that the rotation of the motor 20 in one direction causes the machine to agitate while the rotation of the motor 20 in the opposite direction causes the machine to spin.

FIG. 3D shows the power supply for the circuit. The power supply consists of resistor R13, diode D3, capacitor C12 and Zener diode Z1. The power supply receives 115 VAC from the machine power cord or any other suitable location. A neutral connection N is obtained at the motor reversing cams shown in FIG. 3B. Because of this connection scheme, the power supply will only be activated when the washing machine is in a spin cycle. The capacitor C12 shown in FIG. 3D is charged through resistor R13 and diode D3. Resistor R13 is a high wattage resistor that drops the voltage down from 115 volts. Diode D3 provides half-wave rectification. Zener diode Z1 will conduct whenever the voltage is above 24 volts. This results in a 24 volt DC supply for the relays RL1 and RL2. Voltage regulator U7 (FIG. 3A) regulates the voltage to 5 volts for operating the logic devices shown in FIG. 3A.

The circuit of the present invention can optionally be modified to automatically halt the redistribution routine if the pressure switch SW2 resets. FIG. 3C shows this optional modification. FIG. 3C shows logic components comprised of one-third of U9 and one-fourth of U5 which are connected along with resistors R5, R7, R8, R12, transistor Q3 and Q4, and optocoupler U8. When the pressure switch SW2 (FIG. 3B) resets, neutral N is available at the cathode of optocoupler U8. This causes optocoupler U8 to conduct. This causes current to be diverted from the base of transistor Q4 causing transistor Q4 to turn off. This in turn causes the input to AND gate U9 to be pulled high through resistor R8. The input to AND gate U9 is a combination of the compensation signal previously described and the status of the two relays. When both relays are off, and the compensator signal is high, the output of AND gate U9 will be high. This causes the output of OR gate U5 to be high which turns on transistor Q3 allowing it to conduct. When Q3 conducts, it shorts the timing capacitor C3 of the timing circuit. Note that resistor R5 and transistor Q3 are shown in both FIGS. 3A and 3C. The washing machine 10 will now continue with a normal spin with the redistribution inhibited. The optional circuitry shown in FIG. 3C is desirable, since medium loads may require only one redistribution. Small loads may not require any redistribution. Note that since the input to optocoupler U8 is AC, the actual input to transistor Q3 will be a pulse train at 60 Hz. This pulse train will continually discharge capacitor C3. Because the 60 Hz pulse train is much faster than the timing circuit U6 frequency, the operation occurs as described above.

As shown in FIG. 3A, resistors R1, R4, R6 along with capacitors C1, C2 and C4 hold the flip-flops in a clear status while charging. This allows the flip-flop inputs to stabilize after the initial power up, preventing unexpected outputs.

Also note that capacitors C5–C11 (not shown in the Figures) filter any line transients to prevent unwanted clocking of the logic circuits. Capacitors C5 through C11 are each connected from VCC to ground on each of the components U1 through U7.

The present invention operates as follows and as shown in FIG. 4. The washing machine 10 operates in a typical manner until it reaches a spin cycle. When the washing machine 10 advances to a spin cycle, the power supply shown in FIG. 3D is activated as described above. This causes the flip-flop inputs to stabilize and the timing circuit begins charging.

When the ring counter 16 shown in FIG. 3A receives a negative clock pulse from the timing circuit, the ring counter output state advances from 000 to 100. With the ring counter 16 output state at 100, both relays are held in the off position. Since there is no negative motor relay pulse and the pressure switch SW2 is not reset, the timing circuit is charged and the ring counter 16 then receives another negative clock pulse which causes the ring counter output state to sequence from 100 to 110. Since the output of J-K flip-flop M is now high, the motor relay RL1 is switched on. This causes the washer motor 20 to be deactivated. When the clock circuit pulses again, the output of the ring counter 16 sequences from 110 to 111. Since the output of flip-flop S is now high, the reversing relay RL2 is switched on. This causes the motor windings to be in the agitate state. When the clock circuit pulses again, the outputs of the ring counter 16 sequence from 111 to 101. Now the output of J-K flip-flop M is low causing the motor relay RL1 to deactivate which turns the motor 20 on causing the washer to agitate. Also at this point, since the output of flip-flop M went from a high to a low state (a negative motor relay pulse), the ripple counter output state sequences from 000 to 001. When the clock circuit pulses again, the ring counter 16 output state sequences from 101 to 011. This energizes the motor relay RL1 and stops the washer motor 20. On the next clock circuit pulse, the ring counter output sequences from 011 to 010. This switches off the reversing relay RL2 putting the windings of the motor 20 in the spin state. The clock circuit pulses again and the ring counter 16 output sequences from 010 to 000. This turns off the motor relay RL1 and the washer beings spinning. At the same time, the output of flip-flop M went from a high to a low state (a negative motor relay pulse), so the ripple counter sequences from 001 to 010. Depending on the position of switch SW1, if the output of the ripple counter 18 is taken from the second bit (the output of flip-flop 2), the timing circuit is disabled and the redistribution is complete. If the third bit is selected (the output of flip-flop 3) the previously recited steps are repeated.

As a result of the operation described above, when the washing machine 10 goes to a spin cycle, the load will alternately spin and agitate once or twice and then continue to spin at the top spin speed. Preferably during the third spin, water is sprayed in the basket 12 before the load continues to spin at the top speed.

As shown in FIG. 4, if the water level compensation circuitry is included, the sequence will proceed as described above except that the redistribution will be terminated whenever both relays RL1 and RL2 are in an off condition and the pressure switch SW2 is reset. Termination can also occur if the ripple counter 18 times out. This either/or relationship is achieved with the OR gate U5 connected to transistor Q3 through resistor R5. Note that in either case the washer 10 will be in a natural spin condition when timing is halted (both relays off).

Table 1 includes values for the components of the preferred embodiment. While these are the values of the preferred embodiment, it will be understood that the invention is not limited to these values.

TABLE 1

| Part # | Description | Manufacturer | Manufacturer # |
|---|---|---|---|
| RL1 | SPDT Relay, 15A contact, 24VDC coil | Aromat | JA1c-TM-DC24V-H31 |
| RL2 | DPDT Relay, 20A contact, 24VDC coil | Potter & Brumfield | KUH 4082 |
| D1–D5 | Diode, 1A, 200V | General Instrument | 1N4003 |
| R1–R8 | Resistor, 1K, ¼ Watt | Yageo | 1KQBK |
| R9–R10 | Resistor, 100K, ¼ Watt | Yageo | 100KQBK |
| R11 | Potentiometer, 1M, ½ Watt | Bourns | 3299Y-105 |
| R12 | Resistor, 22K, ¼ Watt | Yadeo | 22KQBK |
| R13 | Resistor, 5.1K, 3W | Yageo | P5.1KW-3TR |
| C1–C4 | Capacitor, 10uF, 35V, tantalum | Panasonic | ECS-F1VE106K |
| C5–C11 | Capacitor, 0.1uF 50V | Phillips | A104M15Z5UFVVWN |
| C12 | Capacitor, 22uF, 50V | Panasonic | ECE-A50Z22 |
| Q1–Q4 | NPN Transistor, 500mA, 40V | National Semiconductor | 2N4401 |
| U1–U3 | Dual JK M/S Flip Flop | National Semiconductor | DM74L573AN |
| U4 | Quad 2-Input AND Gate | National Semiconductor | DM74LS08N |
| U5 | Quad 2-Input OR Gate | National | DM7432N |

TABLE 1-continued

| Part # | Description | Manufacturer | Manufacturer # |
|---|---|---|---|
| U6 | Timer | Semiconductor National Semiconductor | LM555CN |
| U7 | Voltage Regulator 5V, 100mA | National Semiconductor | LM78L05ACM |
| U8 | Optocoupler | Quality Technologies | 4N27 |
| Z1 | Zener Diode, 24V, 1W | ITT | 1N4749ACT |

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. An improved washing machine having a motor, an agitator, and a rotatable basket for holding a load of clothes, the machine having a spin cycle during operation, the improvement comprising:

a circuit electrically connected to the washing machine motor for controlling actuation of the motor;

a timer electrically connected to the circuit; and wherein the circuit causes the washing machine to alternately spin and agitate the clothing during the spin cycle of the washing machine, and wherein the clothing is agitated using a back and forth oscillating motion.

2. The improved washing machine of claim 1 further comprising:

a pressure switch electrically connected to the circuit;

a second circuit for controlling the number of alternate spins and agitations during the spin cycle based on the pressure switch.

3. The improved washing machine of claim 1 wherein the circuit causes water to be sprayed into the washing machine during a portion of the spin cycle.

4. The improved washing machine of claim 1 further comprising a sequencing counter to control the alternate spinning and agitation.

5. The improved washing machine of claim 1 further comprising a first relay electrically connected to the motor for controlling the activation of the motor.

6. The improved washing machine of claim 5 further comprising a second relay electrically connected to the motor for controlling the direction of the motor.

7. The improved washing machine of claim 6 further comprising a sequencing counter, wherein the first and second relays are controlled by the sequencing counter.

8. The improved washing machine of claim 1 wherein the circuit includes of a plurality of flip-flops.

9. The improved washing machine of claim 1 wherein the circuit is comprised of first and second sequencing counters.

10. The improved washing machine of claim 9 wherein the first sequencing counter controls the washing machine motor and the second sequencing counter controls the timer.

11. An improved electromechanical machine having a basket for holding a load, an agitator in the basket for agitating the load, and a motor for rotating the basket and oscillating the agitator, the improvement comprising:

electrical circuitry operatively connected to the motor and basket for preventing an unbalance condition in the basket;

an electrical timer operatively connected to the electrical circuit for controlling the motor to alternately rotate the basket and oscillate the agitator and thereby maintain balance of the load.

12. The improved electromechanical machine of claim 11 further comprising a first relay electrically connected to the electrical circuitry for controlling the activation of the motor.

13. The improved electromechanical machine of claim 12 further comprising a second relay electrically connected to the electrical circuitry for controlling the rotation and agitation of the electromechanical machine.

14. The improved electromechanical machine of claim 13 further comprising a sequential counter electrically connected to the first and second relays for controlling the motor to alternately rotate the basket and oscillate the agitator.

15. The improved electromechanical machine of claim 14 wherein the sequential counter is comprised of a plurality of flip-flops.

16. The improved washing machine of claim 1, wherein the circuit causes the washing machine to pause between the spinning and agitating of the clothing.

17. The improved electromechanical machine of claim 11, wherein the motor is further controlled by the circuit to pause between the spinning and agitating of the clothing.

18. The improved washing machine of claim 1, wherein the washing machine is a vertical axis washing machine.

19. The improved electromechanical machine of claim 11, wherein the machine is a vertical axis machine.

20. An improved washing machine having a motor and a rotatable basket for holding a load of clothes, the machine having a spin cycle during operation, the improvement comprising: p1 a circuit electrically connected to the washing machine motor for controlling actuation of the motor;

a timer electrically connected to the circuit, wherein the circuit causes the washing machine to alternately spin and agitate the clothing during the spin cycle of the washing machine;

a pressure switch electrically connected to the circuit; and a second circuit for controlling the number of alternate spins and agitations during the spin cycle based on the pressure switch.

21. A washing machine having a spin cycle comprising:

a rotatable basket for holding a load of clothes;

an agitator for agitating clothing held in the rotatable basket;

a motor operatively coupled to the rotatable basket and the agitator for causing the rotatable basket to rotate and for causing the agitator to agitate; and a controller for controlling the washing machine during the spin cycle, wherein the controller causes the washing machine to alternately spin and agitate the clothing during the spin cycle of the washing machine.

22. An improved washing machine having a motor and a rotatable basket for holding a load of clothes, the machine having a spin cycle during operation, the improvement comprising:

a circuit electrically connected to the washing machine motor for controlling actuation of the motor;

a timer electrically connected to the circuit; and wherein the circuit causes the washing machine to alternately spin and agitate the clothing during the spin cycle of the washing machine, and wherein the circuit causes the washing machine to pause between the spinning and agitating of the clothing.

* * * * *